United States Patent [19]

Reed, Jr. et al.

[11] 4,180,424

[45] Dec. 25, 1979

[54] CONTROL OF BURNING RATE AND BURNING RATE EXPONENT BY PARTICLE SIZE IN GUN PROPELLANTS

[75] Inventors: Russell Reed, Jr., Ridgecrest, Calif.; John A. Peterson, Brigham City, Utah; Raymond M. Price, Hollister, Calif.

[73] Assignee: The United States of America as represented by the Secretary of the Army, Washington, D.C.

[21] Appl. No.: 814,574

[22] Filed: Jul. 11, 1977

Related U.S. Application Data

[63] Continuation of Ser. No. 668,455, Mar. 17, 1976, which is a continuation of Ser. No. 324,451, Jan. 17, 1973, abandoned.

[51] Int. Cl.[2] ..... C06B 45/10

[52] U.S. Cl. ..... 149/19.4; 149/19.1; 149/19.6; 149/19.9; 149/19.91; 149/92; 149/111

[58] Field of Search ..... 149/19.1, 19.4, 92, 149/111, 19.6, 19.9, 19.91

[56] References Cited

U.S. PATENT DOCUMENTS

| | | | |
|---|---|---|---|
| 3,386,868 | 6/1968 | Gimler et al. | 149/92 |
| 3,725,154 | 4/1973 | McCulloch et al. | 149/92 |
| 3,756,874 | 9/1973 | Chang et al. | 149/92 |

*Primary Examiner*—Stephen J. Lechert, Jr.

*Attorney, Agent, or Firm*—Nathan Edelberg; Harold H. Card, Jr.; A. Victor Erkkila

[57] ABSTRACT

Composite gun propellants are prepared wherein the burning rate and burning rate exponent are controlled by proper choice of particle size. This invention permits the formulation of practical, high impetus, composite gun propellants, tailored specifically to yield the desired ballistic properties for a specific round.

7 Claims, No Drawings

CONTROL OF BURNING RATE AND BURNING RATE EXPONENT BY PARTICLE SIZE IN GUN PROPELLANTS

This is a continuation, of application Ser. No. 668,455 filed Mar. 17, 1976, which is a continuation of Ser. No. 324,451, Jan. 17, 1973, now abandoned.

BACKGROUND OF THE INVENTION

1. Field of the Invention

This invention relates to a method for improving composite gun propellants. Particularly it relates to a method for controlling the exponent "n" of the conventional burning rate equation $r=ap^n$ by controlling the particle size of the solid component of the propellant. Additionally, the exponent may be controlled, though to a lesser extent by the amount of the solid component in the propellant.

More particularly, it has been found that by reducing the particle size of the solid component of a gun propellant, both the burning rate and the burning rate exponent are reduced.

Most particularly, it relates to the control of the burning rate exponent by control of the particle size of cyclotetramethylenetetramine (HMX)-containing propellants.

DESCRIPTION OF THE PRIOR ART

Conventional gun propellants are colloidal, as opposed to being composite, and as such are composed of nitrocellulose, both with and without nitroglycerine, certain stabilizers, and ballistic modifiers. These conventional propellants exhibit such high flame temperatures that rapid firing automatic weapons quickly reach their metallurgical limits, and barrel erosion occurs very rapidly.

As a result of these limitations, composite gun propellants containing a solid "oxidizer" component in a polymeric binder have several theoretical advantages. They have much lower flame temperatures for equivalent energy production, and therefore at equal temperatures the composite propellants can be formulated to yield greatly increased energy in comparison with colloidal propellants.

Secondary cyclic nitramines, such as cyclotetramethylenetetranitramine (HMX), are very attractive theoretically for use in composite gun propellants as they are calculated to have the desirable attributes of low flame temperature and high impetus. Moreover, they are thermally stable and insensitive to shock, friction and impact when compared to nitrocellulose. Accordingly, numerous patents disclose their use as such, but in no case did these propellants produce good efficiency in guns. These prior HMX propellants are characterized by difficulty of ignition, high and rapid pressure excursions, and very poor piezometric efficiencies.

A characteristic that has caused poor performance in guns with HMX-type composite propellants that have been used heretofore is that the burning rate exponent "n" in the equation that describes the burning rate-pressure relationship $r=ap^n$ changes with pressure. At moderate pressures, i.e. less than 5000 psi, this exponent in previous HMX propellants has been similar to that typical of colloidal propellants, e.g. 0.9. However, at the higher pressures at which gun propellants operate, the previous HMX propellants have an increased exponent typically reaching 1.7 or above in the neighborhood of 30,000 psi, whereas the conventional colloidal propellant exponents remain constant at about 0.9.

The high burning rate exponent of HMX-containing composite gun propellants yields very high burning rates at the higher pressures, and since the burning rate serves to increase the pressure further, these previous propellants are typified by uncontrollable high pressure ballistics, poor repeatability, and very poor piezometric efficiency.

SUMMARY OF THE INVENTION

It is an object of this invention to produce composite gun propellants wherein the burning rate and the burning rate exponent are controlled to be in a desired range.

Another object of this invention is to reduce the burning rate and burning rate exponent of composite gun propellants by reducing the particle size of at least the solid component.

A further object of this invention is to produce a composite gun propellant wherein the burning rate exponent is constant up to at least about the 50,000 psi region which is about the maximum pressure of interest for gun propellants.

A further object is to produce commercially satisfactory composite gun propellants with both excellent repeatability and good piezometric efficiency.

DESCRIPTION OF THE PREFERRED EMBODIMENTS

The composite gun propellants to be prepared according to the process of this invention contain a solid component, or mixtures thereof, and a binder, or mixtures thereof, as well as any other normal additives, i.e. accelerators coolants, metals like aluminum, carbon black, etc.

The solid "oxidizer" component is usually present in an amount of from about 60 to 95% of the total weight of the propellant. The solid component may be any nitramine type compound such as, but not limited to, cyclotetramethylenetetranitramine (HMX), cyclotrimethylenetrinitramine (RDX). Additionally, other solid components may be used, such as ammonium nitrate, diammonium bitetrazole, ammonium picrate, 1,2-dicyanotetranitroethane, hexanenitroethane, flourotrinitromethane and dihydrazinium 3,6-bis(5-tetrazoyl) dihydrotetrazine. Preferably HMX and RDX are used, and most preferably HMX due to its inherent stability properties.

The binder component is usually present in an amount of from about 5 to 40% of the total weight of the propellant and may be any suitable liquid or solid binder. These include polyurethanes, polyacrylates, polysulfides, polyepoxides, hydrocarbon polymers and polyformaldehyde polymers. Examples of these various broad catagories of binders include, but are not limited to, the following: polyurethanes prepared from polyisocyanates and one of the following: hydroxyl-terminated copolymers of propylene oxide and ethylene oxide, hydroxy-terminated polyethylene oxide polymers, hydroxyl-terminated polypropylene oxide polymers, polyethylene glycol polymers, polyesters, and other polyethers; N-butyl acrylate, N-hexyl methacrylate, lauryl methacrylate, isobutyl acrylate, 2-ethylhexyl acrylate, N-butyl methacrylate, methyl methacrylate, stearyl methacrylate, glycidyl methacrylate, and hydroxyethyl methacrylate; polysulfide liquid polymers such as those manufactured by Thiokol Chemical Corporation under the trademark LP; hydrocarbon polymers such as polybutadiene polymers and copolymers with styrene and acrylonitrile; epoxy resins such as DER 321, described in Epoxy Resins by Lee and Neville, at page 19; polyformaldehyde polymers; polyvinylene carbonate polymers and copolymers with polyformaldehyde polymers; and copolymers of aldehydes and alcohols, i.e. any normal propellant binder may be used herein and the above list is not meant to be limiting in any way.

The binders are required to provide sufficient strength to prevent mechanical failure during storage or combustion and to provide more easily oxidizable characteristics to the propellant while stabilizing the explosive characteristics of the solid component. They should also be chemically compatible with and interact with the solid component and any other compounds in the propellant. Of course various crosslinking agents and curing agents are used with the binders.

Additional additives such as accelerators, coolants like oxamide, and carbon black may also be present in the propellant and may comprise about 0 to 25% of the total weight of the propellant.

A more detailed description to suitable binder and methods of preparation thereof may be found in copending, cofiled U.S. applications Ser. Nos. 329,257 and 329,258 also assigned to Thiokol Chemical Corporation.

As stated, previous composite gun propellants were unsuitable for practical use due to their high burning rate and high burning rate exponent which resulted in uncontrollable ballistics. The method of solving this interrelated problem according to our invention is to control the burning rate exponent, and thereby the burning rate, by controlling the particle size of the solid component; i.e. by reducing the particle size, the burning rate exponent is reduced. This relationship of slower burning with smaller particles is directly contrary to the faster burning that results from smaller particles with rocket propellants. If the exponent is reduced to 0.9 the gun propellants will have similar burning characteristics to conventional gun propellants but with increased mass impetus for a given weight and physical structure of propellant.

The production of the very small particles of the solid component which result in the improved propellants may be performed through any particle size reduction method that is available; i.e. grinding in any type mill, or by chemical action. A particular difficulty in grinding the solid components of this invention is that they are explosive and a considerable static electricity charge develops during the grinding operation making it a particularly dangerous operation. Accordingly, it has been found that fluid energy milling of the solid component is an advantageous method of reducing its particle size. It is especially advantageous to perform the milling operation at temperature below about 85° F. While this may be performed by milling the solid component by itself, the addition of a small amount of an anti-static agent which will not poison the propellant has been found to reduce the inherent danger. Additionally, when the binder is solid rather than liquid, it may be milled together with the solid component to promote a more intimate mixture of the two ingredients, and in fact a coating-type relationship of the binder and the solid component.

The fluid energy milling of the solid component, with or without the anti-static agent, and with or without the binder, may be performed in a standard manner, such as, the following: a fluid energy mill is designed to grind continuously any solid by means of pressurized elastic fluids such as compressed air. The mill is a hollow elongated torus placed vertically with a lower zone thereof for grinding and the upper zone for classifying. The elastic fluid is introduced to the mill tangentially through special nozzles at pressures from 25 to 250 psig. The high pressure fluid, as it expands to the lower internal mill pressure, is converted to sonic or supersonic jet streams. Thus a rapidly circulating flow is generated in the hollow doughnut-shaped mill casing. At the lower zone is a venturi or vibra-screw ray material feeder where unground material is introduced continuously, at a predetermined feed rate, and is entrained in the rapidly circulating turbulent flow, and is immediately pulverized by mutual impact and attrition. In the upper classifying zone, centrifugal force stratifies larger, heavier particles at the outer periphery, with finer particles traveling at the inner periphery of the shell. In the classifying zone an outlet is provided wherein spent fluid is continuously withdrawn, carrying within its particles fine enough to be entrapped by the viscous drag of the leaving gas. The larger particles, due to their greater momentum, are carried past the outlet and down stack for further grinding. Two methods for controlling the particle size of the material to be ground up are by changing (1) the pressure at which the elastic fluid is introduced to the mill and/or (2) the diameters of the special nozzles through which the elastic fluid is introduced.

As indicated above, the addition of an anti-static agent during the milling of the solid component has been found to reduce the inherent danger in the milling operation. The anti-static agent used may be any of the general ones sold as such as long as it doesn't poison the propellant, i.e., affect adversely the properties of the resultant propellant. The anti-static agents may be classified into four chemical categories: amine derivatives, quaternary ammonium salts, phosphate esters, and polyethylene glycol esters Most preferred is Carbowax 4000, a polyethylene glycol produced by Union Carbide. Any of the anti-static agents should be used from about 0.5 to about 3% by weight of the solid component that is milled.

To prepare a gun propellent, a solid component of the type previously discussed is reduced to the desired particle size which will provide the proper burning characteristics; to this is added a binder and curing agent therefor, and the ingredients are then thoroughly mixed to produce an intimate mixture. As indicated above these steps may be performed at one time if a solid-type binder is used and the ingredients are all milled together. When a liquid binder is used, the proper sized solid component is mixed therewith to produce a viscous mixture which makes it easy to extrude the mixture at moderate pressures through an orifice of about 0.15 inches in diameter. The extruded material may then be cured and tested.

When a solid binder is used, the mixture of the binder and the solid component may be pressed into thin wafers and then cured with the thickness and diameter of the wafers affecting the burning characteristics of the propellant. Advantageously, the mixture may be agglomerated by means of a roll compactor—this may be a necessary step due to the lack of free flowing characteristics of the fine particled mixture depending on the particle sizes used. During the agglomeration only enough pressure is applied to consolidate the propellant into thin sheets which may be then be broken up into particles of about 20 mesh or finer so that they may be pressed into wafers and cured as above.

Another method of preparing a gun propellant is by solvent extrusion, i.e. making a solid binder-HMX mix fluid by the addition of a solvent, extruding the propellant, and extracting the solvent. The propellant is then cured. This procedure is similar to the method of preparing colloidal propellants.

EXAMPLE 1

Propellant compositions were prepared varying the particle size of the solid component as shown below. HMX was selected for use as the solid component in this example. Also used was a polyurethane binder prepared from a 50/50 ethylene oxide/propylene oxide copolymer and lysine diisocyanate methyl ester. The HMX was reduced from about an average mean particle diameter of 60μ to the listed particle sizes by means of fluid energy milling together with about 1% by weight of a polyethylene glycol of molecular weight 4000 as an anti-static agent, and together with the binder ingredients as listed below. The propellant powders were then cold pressed at pressures of 5000 to 25,000 psi into pellets about 0.03 inches thick. The pellets were then oven cured at slightly above 210° F. for about 12 hours. Finally, the pellets were fired in an impulse bomb to obtain the buring rate and burning rate exponent values. The compositions used and the results are listed in Table I.

The results accurately demonstrate that by reducing the particle size of the solid component, the burning rate and the burning rate exponent are reduced. Or, in other words, as the particle size is reduced, so is the burning rate, i.e. smaller particles result in slower burning.

TABLE I

| Composition (parts by weight) | A | B | C |
|---|---|---|---|
| 50/50 Ethylene Oxide/Propylene Oxide Copolymer | 11.99 | 11.99 | 11.99 |
| Lysine diisocyanate methyl ester | 9.81 | 9.81 | 9.81 |
| Trimethylolpropane | 3.26 | 3.26 | 3.26 |
| Titanyl acetylacetonate | 0.10 | 0.10 | 0.10 |
| HMX -60μ | 75.00 | — | — |
| 6μ | — | 52.50 | — |
| 2μ | — | 22.50 | 75.00 |
| Results of Impulse Bomb | | | |
| Pressure Exponent | 1.81 | 1.06 | 0.91 |
| Burning Rate (in/sec at psi) | | | |
| 10,000 psi | 6.50 | 1.10 | 1.05 |
| 25,000 psi | 35.0 | 2.85 | 2.40 |
| 50,000 psi | 130. | 5.80 | 4.60 |

EXAMPLE 2

This example shows the effect of varying the binder and the amount of HMX in a propellant composition wherein the HMX is used with a particle of 2μ. The procedure for preparing the propellants of Example 1 was repeated except for varying the binders and quantity of 2μ HMX.

The compositions used were as follows:

| Ingredients | | | |
|---|---|---|---|
| HMX -2μ | 75 | 80 | 85 |
| 50/50 Ethylene oxide/propylene oxide copolymer | 11.99 | — | — |
| Polyethylene glycol of 4000 mol. wt. | — | 9.49 | 11.93 |
| Lysine diisocyanate methyl ester | 9.81 | — | — |
| Toluene diisocyanate | — | 8.24 | 2.59 |
| Trimethylolpropane | 3.26 | 2.27 | 0.48 |
| Titanyl acetylacetonate | 0.10 | — | — |
| Ferric acetylacetonate | — | 0.20 | 0.20 |

The results of the impulse bomb tests were as follows:

| | | | |
|---|---|---|---|
| Pressure Exponent | 0.91 | 1.21 | 1.30 |
| Burning Rate (in/sec at psi) | | | |
| 10,000 psi | 1.05 | 1.95 | 2.95 |
| 25,000 psi | 2.40 | 5.80 | 9.60 |
| 50,000 psi | 4.60 | 13.0 | 24.5 |

Accordingly, it is shown that by varying the amount of the solid component the burning rate and the burning rate exponent may be varied though the particle size control of Example 1 exerts a greater impact thereon.

What is claimed is:

1. A method for controlling the burning rate exponent of a gun propellent comprising a solid binder and an oxidizer consisting essentially of cyclotetramethylenetetranitramine and devoid of coolant and inorganic oxidizers, which comprises reducing the average mean particle diameter of at least the cyclotetramethylenetetranitramine to less than 60 microns sufficient to provide said propellant a burning rate exponent n, as defined by the equation $R=ap^n$, between about 0.9 and 1.3 at a pressure between 10,000 and 50,000 psi.

2. A method according to claim 1, wherein the particle size of the cyclotetramethylenetetranitramine is reduced to between about 1 and 6 microns.

3. A method according to claim 1, wherein the cyclotetramethylenetetranitramine comprises 60% to 95% by weight of the propellant.

4. A method according to claim 1, wherein the binder is selected from the group consisting of polyurethanes, polyacrylates, polysulfides, polyformaldehydes, polyepoxides and hydrocarbon polymers.

5. A method according to claim 1, wherein the binder is a polyurethane binder.

6. A method according to claim 1, wherein the reduction in particle size of at least the cyclotetramethylenetetranitramine is accomplished by fluid energy milling.

7. A method according to claim 6, wherein the cyclotetramethylenetetranitramine is milled in the presence of about 0.5 to 3.0 weight percent of a polyethylene glycol anti-static agent having a mol. wt. of about 4000.

* * * * *